US011640786B2

(12) United States Patent
Chen et al.

(10) Patent No.: US 11,640,786 B2
(45) Date of Patent: May 2, 2023

(54) DISPLAY PANEL, METHOD OF DRIVING THE SAME AND DISPLAY DEVICE

(71) Applicants: Chengdu BOE Optoelectronics Technology Co., Ltd., Chengdu (CN); BOE TECHNOLOGY GROUP CO., LTD., Beijing (CN)

(72) Inventors: Wenbin Chen, Beijing (CN); Rongjian Yan, Beijing (CN); Guangjun Song, Beijing (CN); Zhaowei Yu, Beijing (CN); Yamin Yang, Beijing (CN); Wenqiang Zhang, Beijing (CN)

(73) Assignees: Chengdu BOE Optoelectronics Technology Co., Ltd., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 150 days.

(21) Appl. No.: 17/417,153

(22) PCT Filed: Nov. 9, 2020

(86) PCT No.: PCT/CN2020/127583
§ 371 (c)(1),
(2) Date: Jun. 22, 2021

(87) PCT Pub. No.: WO2022/095044
PCT Pub. Date: May 12, 2022

(65) Prior Publication Data

US 2022/0366841 A1 Nov. 17, 2022

(51) Int. Cl.
*G09G 5/10* (2006.01)
*G09G 3/3208* (2016.01)

(52) U.S. Cl.
CPC ..... *G09G 3/3208* (2013.01); *G09G 5/10* (2013.01); *G09G 2320/0233* (2013.01); *G09G 2320/064* (2013.01); *G09G 2320/0673* (2013.01)

(58) Field of Classification Search
CPC ..... G09G 3/3208; G09G 5/10; G09G 2320/0233; G09G 2320/064;
(Continued)

(56) References Cited

U.S. PATENT DOCUMENTS

| | | | | |
|---|---|---|---|---|
| 8,686,653 | B2 | 4/2014 | Gao | |
| 2013/0057166 | A1 | 3/2013 | Gao | |
| 2013/0235090 | A1* | 9/2013 | Choi | G09G 3/342 315/186 |
| 2015/0152965 | A1* | 6/2015 | Ha | B60Q 3/80 315/77 |

(Continued)

FOREIGN PATENT DOCUMENTS

| | | | |
|---|---|---|---|
| CN | 1540615 | A | 10/2004 |
| CN | 101937651 | A | 1/2011 |

(Continued)

OTHER PUBLICATIONS

Written Opinion for International Application No. PCT/CN2020/127583 dated Apr. 28, 2021.

*Primary Examiner* — Rodney Amadiz
(74) *Attorney, Agent, or Firm* — Perilla Knox & Hildebrandt LLP; Kenneth A. Knox

(57) ABSTRACT

A driving method includes, at a first display brightness value, inputting a pulse-width modulation signal with a duty ratio of X, and controlling a light-emitting driving current of a sub-pixel unit to be M, wherein X and M are obtained according to a first modulation rule; and at a second display brightness value, inputting the pulse-width modulation signal with a duty ratio of Y1, and controlling the light-emitting
(Continued)

driving current of the sub-pixel unit to be N1, wherein the first display brightness value is greater than the second one, wherein, when the duty ratio and the light-emitting driving current corresponding to the second display brightness value are obtained according to the first modulation rule, the duty ratio corresponding to the second display brightness value is Y2, the light-emitting driving current corresponding to the second display brightness value is N2, Y1 is smaller than Y2, and N1 is greater than N2.

17 Claims, 7 Drawing Sheets

(58) Field of Classification Search
CPC ..... G09G 2320/0673; G09G 2300/0819; G09G 2300/0842; G09G 2300/0861; G09G 3/3233; G09G 2310/0216; G09G 2310/0251; G09G 2320/0238; G09G 2320/0242; G09G 2320/0653
See application file for complete search history.

(56) References Cited

U.S. PATENT DOCUMENTS

| | | | | |
|---|---|---|---|---|
| 2016/0293097 | A1* | 10/2016 | Momoeda | G09G 3/2096 |
| 2020/0168169 | A1* | 5/2020 | Yoda | G09G 3/3648 |
| 2022/0351705 | A1* | 11/2022 | Ye | G09G 5/10 |

FOREIGN PATENT DOCUMENTS

| | | | |
|---|---|---|---|
| CN | 102237044 | A | 11/2011 |
| CN | 102243854 | A | 11/2011 |
| CN | 102779480 | A | 11/2012 |
| CN | 101937651 | B | 1/2014 |
| CN | 203456070 | U | 2/2014 |
| CN | 102237044 | B | 8/2014 |
| CN | 104392698 | A | 3/2015 |
| CN | 111210765 | A | 5/2020 |
| CN | 111785209 | A | 10/2020 |
| JP | 2004354762 | A | 12/2004 |
| JP | 1507511 | B2 | 7/2010 |

* cited by examiner

DISPLAY PANEL, METHOD OF DRIVING THE SAME AND DISPLAY DEVICE

CROSS-REFERENCE TO RELATED APPLICATIONS

The present application is a national phase application under 35 U.S.C. § 371 of International Application No. PCT/CN2020/127583, filed on Nov. 9, 2020, the contents of which being incorporated by reference in their entirety herein.

TECHNICAL FIELD

The present disclosure relates to the display technology, and more particularly, to a display panel, a method of driving the same, and a display device.

BACKGROUND

In the related technology, a display panel generally includes a plurality of pixel driving circuits, each of the driving circuits includes a drive transistor, and the drive transistor is configured to provide a driving current to a light-emitting unit under the action of a data signal to drive the light-emitting unit to emit light. However, the driving current output from the drive transistor is susceptible to fluctuations due to external factors. Especially in a low display brightness value range of the display panel, the current output from the drive transistor is small, thus, under the interference of the external factors, the light-emitting unit is extremely vulnerable to large fluctuation in brightness, causing color shift of the display panel and other display problems.

It should be noted that information disclosed in this part is provided only for acquiring a better understanding of the background of the present application and therefore may include information that is not prior art already known to those of ordinary skill in the art.

SUMMARY

According to an aspect of the present disclosure, there is provided a method of driving a display panel, wherein the display panel includes a plurality of sub-pixel units, and the method of driving the display panel includes:

at a first display brightness value, inputting a pulse-width modulation signal with a duty ratio of X to the display panel, and controlling a light-emitting driving current of the sub-pixel unit to be M, wherein the duty ratio of the pulse-width modulation signal is in positive correlation with a light-emitting duration of the sub-pixel unit in one driving cycle, X and M are obtained according to a first modulation rule, X>0, and M>0; and at a second display brightness value, inputting the pulse-width modulation signal with a duty ratio of Y1 to the display panel, and controlling the light-emitting driving current of the sub-pixel unit to be N1, wherein the first display brightness value is greater than the second display brightness value, Y1>0, and N1>0, wherein, when the pulse-width modulation signal and the light-emitting driving current corresponding to the second display brightness value are obtained according to the first modulation rule, the duty ratio of the pulse-width modulation signal corresponding to the second display brightness value is Y2, the light-emitting driving current corresponding to the second display brightness value is N2, Y2>0, N2>0, Y1 is smaller than Y2, and N1 is greater than N2.

In an exemplary embodiment of the present disclosure, the second display brightness value is equal to or less than K1, and the first display brightness value is greater than K1.

In an exemplary embodiment of the present disclosure, K1 is equal to or greater than 2 nits, and K1 is equal to or less than 32 nits.

In an exemplary embodiment of the present disclosure, the sub-pixel unit includes a pixel driving circuit and a light-emitting unit, the pixel driving circuit includes a first switching element connected between a first power supply terminal and a light-emitting unit, and the first switching unit is configured to turn on the first power supply terminal and the light-emitting unit in response to an enable signal, and the duty ratio of the pulse-width modulation signal is in positive correlation with a duty ratio of the enable signal.

In an exemplary embodiment of the present disclosure, the display panel includes a gate electrode driving circuit, and the gate electrode driving circuit is configured to provide the enable signal to the first switching unit, and the pulse-width modulation signal is an initial trigger signal of the gate electrode driving circuit.

In an exemplary embodiment of the present disclosure, Y1 is smaller than X, and N1 is greater than M.

In an exemplary embodiment of the present disclosure, the method of driving the display panel includes:

adjusting a display brightness value of the display panel by a power dimming mode when the display brightness value of the display panel is greater than K2; and adjusting the display brightness value of the display panel by a pulse-width modulation signal dimming mode when the display brightness value of the display panel is equal to or less than K2, wherein K1 is less than K2.

In an exemplary embodiment of the present disclosure, when the pulse-width modulation signal and the light-emitting driving current corresponding to the second display brightness value are obtained according to the first modulation rule, the second display brightness value corresponds to a first gamma level, and controlling the light-emitting driving current of the sub-pixel unit to be M includes:

controlling the light-emitting driving current of the sub-pixel unit based on a second gamma level, wherein the light-emitting driving current generated based on the second gamma level is greater than the light-emitting driving current generated based on the first gamma level at the same gray scale.

In an exemplary embodiment of the present disclosure, N1*Y1 is equal to N2*Y2.

According to an aspect of the present disclosure, there is further provided a method of driving a display panel, wherein the method of driving the display panel includes:

at a first display brightness value, inputting a pulse-width modulation signal with a duty ratio of X to the display panel, and controlling a light-emitting driving current of a sub-pixel unit in the display panel to be M; and at a second display brightness value, inputting the pulse-width modulation signal with a duty ratio of Y1 to the display panel, and controlling the light-emitting driving current of the sub-pixel unit in the display panel to be N1, wherein the duty ratio of the pulse-width modulation signal is in positive correlation with a light-emitting duration of the sub-pixel unit in one driving cycle, the first display brightness value is greater than the second display brightness value, N1>M, and Y1<X.

In an exemplary embodiment of the present disclosure, the second display brightness value is equal to or less than K1, and the first display brightness value is greater than K1.

In an exemplary embodiment of the present disclosure, the sub-pixel unit includes a pixel driving circuit and a light-emitting unit, the pixel driving circuit includes a first switching element connected between a first power supply terminal and a light-emitting unit, the first switching unit is configured to turn on the first power supply terminal and the light-emitting unit in response to an enable signal, and the duty ratio of the pulse-width modulation signal is in positive correlation with a duty ratio of the enable signal.

In an exemplary embodiment of the present disclosure, the display panel includes a gate electrode driving circuit, the gate electrode driving circuit is configured to provide the enable signal to the first switching unit, and the pulse-width modulation signal is an initial trigger signal of the gate electrode driving circuit.

In an exemplary embodiment of the present disclosure, X and M are obtained according to a first modulation rule, and when the pulse-width modulation signal and the light-emitting driving current corresponding to the second display brightness value are obtained according to the first modulation rule, the second display brightness value corresponds to a first gamma level, and controlling the light-emitting driving current of the sub-pixel unit to be M includes: controlling the light-emitting driving current of the sub-pixel unit based on a second gamma level, wherein the light-emitting driving current generated based on the second gamma level is greater than the light-emitting driving current generated based on the first gamma level at the same gray scale.

According to an aspect of the present disclosure, there is provided a display panel, and the display panel is driven according to the method of driving the display panel.

According to an aspect of the present disclosure, there is provided a display panel, including: a plurality of sub-pixel units, a gate electrode driving circuit, a source electrode driving circuit, a gamma circuit, a processing circuit and a driving circuit. Each of the sub-pixel units includes a pixel driving circuit, the pixel driving circuit includes a first switching element connected between a first power supply terminal and a light-emitting unit, and the first switching unit is configured to turn on the first power supply terminal and the light-emitting unit in response to an enable signal. The gate electrode driving circuit is configured to provide the enable signal to the first switching unit. The source electrode driving circuit is configured to input a driving voltage to the pixel driving circuit, The gamma circuit includes a plurality of sets of gamma registers, each set of the gamma registers stores a set of gamma data, each set of gamma data corresponds to a gamma level, and each of the gamma levels corresponds to a display brightness value and a pulse-width modulation signal. The processing circuit is configured, according to the gamma levels corresponding to each set of gamma register as well as the display brightness value and the pulse-width modulation signal corresponding to each of the gamma levels, to obtain the pulse-width modulation signal and the gamma level corresponding to any display brightness value. The driving circuit is configured to call the pulse-width modulation signal and the gamma level corresponding to any display brightness value, to control the gate electrode driving circuit to output the enable signal based on the pulse-width modulation signal, and control the source electrode driving circuit to output the driving voltage based on the gamma level. A duty ratio of the pulse-width modulation signal corresponding to a first display brightness value is X, the first display brightness value corresponds to a third gamma level, and based on the third gamma level, a light-emitting driving current of the pixel driving circuit is M, the pulse-width modulation signal and the gamma level corresponding to the first display brightness value are obtained according to a first modulation rule, X>0, and M>0. A duty ratio of the pulse-width modulation signal corresponding to a second display brightness value is Y1, the second display brightness value corresponds to a second gamma level, and based on the second gamma level, the light-emitting driving current of the pixel driving circuit is N1, Y1>0, and N1>0. When the pulse-width modulation signal and the gamma level corresponding to the second display brightness value are obtained according to the first modulation rule, the duty ratio of the pulse-width modulation signal corresponding to the second display brightness value is Y2, the light-emitting driving current of the pixel driving circuit is N2, Y2>0, N2>0, Y1 is less than Y2, and N1 is greater than N2.

In an exemplary embodiment of the present disclosure, the second display brightness value is equal to or less than K1, and the first display brightness value is greater than K1.

In an exemplary embodiment of the present disclosure, the second display brightness value corresponds to a first gamma level when the pulse-width modulation signal and the gamma level corresponding to the second display brightness value are obtained according to the first modulation rule, wherein the light-emitting driving current generated based on the second gamma level is greater than the light-emitting driving current generated based on the first gamma level at the same gray scale.

According to an aspect of the present disclosure, there is provided a method of dimming a display panel, including:

obtaining pulse-width modulation signals and light-emitting driving currents corresponding to a first display brightness value and a second display brightness value, having different display brightness values based on the first modulation rule, wherein the first display brightness value is larger than the second display brightness value, wherein a duty ratio of a pulse-width modulation signal corresponding to a second display brightness value is Y2, a light-emitting driving current is N2, Y2>0, N2>0, and the second display brightness value is less than K1; and adjusting the duty ratio Y2 of the pulse-width modulation signal corresponding to the second display brightness value to Y1, and adjusting the light-emitting driving current corresponding to the second display brightness value to N1, wherein Y1>0, N1>0, Y1 is smaller than Y2, and N1 is greater than N2.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments consistent with the invention and, together with the description, serve to explain the principles of the invention. Understandably, the drawings in the following description are only some embodiments of the present disclosure, and those skilled in the art can further obtain other drawings based on these drawings without any creative work. In the drawings.

DETAILED DESCRIPTION

Figure 1:
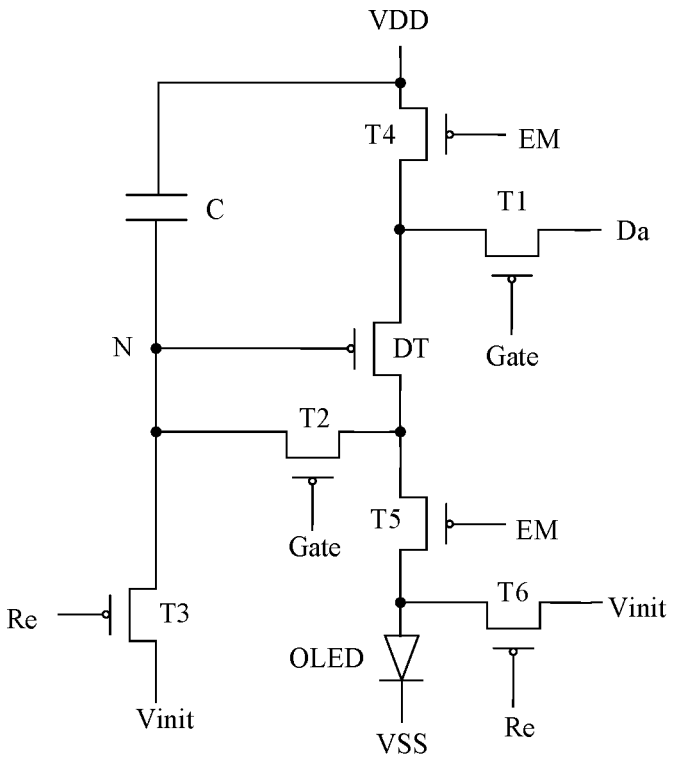
FIG. 1 is a structural schematic diagram of a pixel driving circuit in the related technology.

Exemplary embodiments will now be described more fully with reference to the accompanying drawings. However, the exemplary embodiments may be embodied in a variety of forms and should not be construed as being limited to the embodiments set forth herein. On the contrary, the embodiments are provided to make the present disclosure comprehensive and through and to fully convey the concept of the exemplary embodiments to those skilled in the art. The same reference signs in the drawings denote the same or similar structures, and detailed descriptions thereof will be omitted.

Although terms having opposite meanings such as "on" and "below" are used herein to describe the relationship of one component relative to another component, such terms are used herein only for the sake of convenience, for example, "in the direction illustrated in the figure". It can be understood that if a device denoted in the drawings is turned upside down, a component described as "on" something will become a component described as "below" something. When a structure is described as "on" another structure, it probably means that the structure is integrally formed on another structure, or, the structure is "directly" disposed on another structure, or, the structure is "indirectly" disposed on another structure through an additional structure.

Words such as "one", "an/a" and "the" are used herein to indicate the presence of one or more elements/component parts/and others. Terms "including" and "having" have an inclusive meaning which means that there may be additional elements/component parts/and others in addition to the listed elements/component parts/and others.

FIG. 1 is a structural schematic diagram illustrating a pixel driving circuit in the related technology. The pixel driving circuit may include: a drive transistor DT, a first transistor T1, a second transistor T2, a third transistor T3, a fourth transistor T4, a fifth transistor T5, a sixth transistor T6 and a capacitor C. The first transistor T1 has a first electrode connected to a data signal terminal Da, a second electrode connected to a first electrode of a drive transistor DT, and a gate electrode connected to a gate electrode drive signal terminal Gate. The fourth transistor T4 has a first electrode connected to a first power supply terminal VDD, a second electrode connected to the first electrode of the drive transistor DT, and a gate electrode connected to an enable signal terminal EM. The drive transistor DT has a gate electrode connected to a node N, and a second electrode connected to a first electrode of the fifth transistor T5. The second transistor T2 has a first electrode connected to the node N, a second electrode connected to the second electrode of the drive transistor DT, and a gate electrode connected to the gate electrode drive signal terminal Gate. The fifth transistor T5 has a second electrode connected to a first electrode of the sixth transistor T6, and a gate electrode connected to the enable signal terminal EM. The sixth transistor T6 has a second electrode connected to an initialization signal terminal Vinit, and a gate electrode connected to a reset signal terminal Re. The third transistor T3 has a first electrode connected to the node N, a second electrode connected to the initialization signal terminal Vinit, and a gate electrode connected to the reset signal terminal Re. The capacitor C is connected between the first power supply terminal VDD and the node N. The pixel driving circuit may be connected to a light-emitting unit OLED, and the light-emitting unit OLED is connected between the second electrode of the fifth transistor T5 and a second power supply terminal VSS. The drive transistor DT, the first transistor T1, the second transistor T2, the third transistor T3, the fourth transistor T4, the fifth transistor T5 and the sixth transistor T6 may be P-type transistors.

Figure 2:
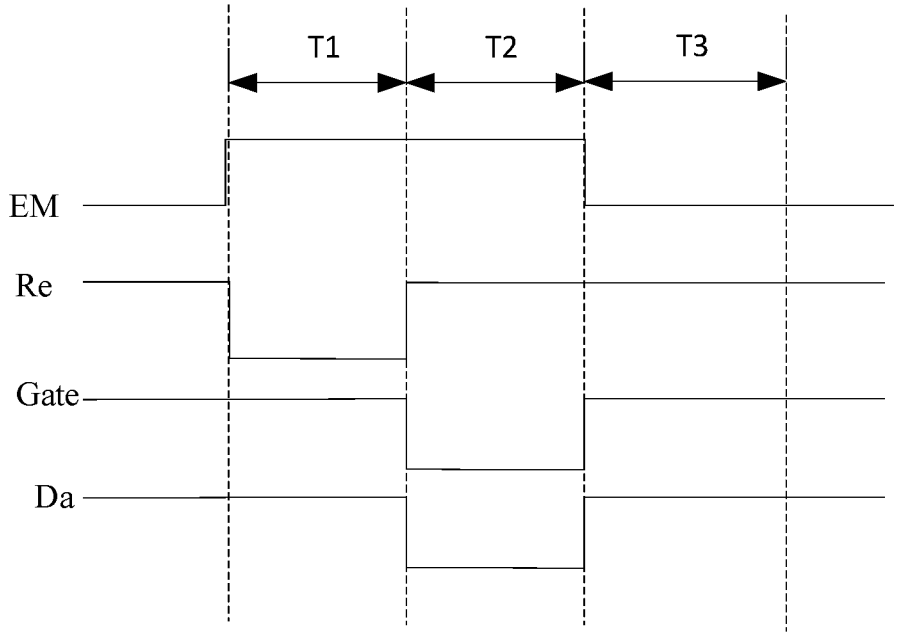
FIG. 2 is a timing diagram of respective nodes in a driving method of the pixel driving circuit shown in FIG. 1.

FIG. 2 is a timing diagram of respective nodes in a driving method of the pixel driving circuit shown in FIG. 1. Gate denotes the timing of the gate electrode drive signal terminal Gate, Re denotes the timing of the reset signal terminal Re, EM denotes the timing of the enable signal terminal EM, and Da denotes the timing of the data signal terminal Da. The driving method of the pixel driving circuit may include a reset phase T1, a compensation phase T2 and an illumination phase T3. In the reset phase T1: a low level signal is output from the reset signal terminal Re, the third transistor T3 and the sixth transistor T6 are turned on, and an initialization signal is input to the node N and the second electrode of the fifth transistor T5 from the initialization signal terminal Vinit. In the compensation phase T2: a low level signal is output from the gate electrode drive signal terminal Gate, the first transistor T1 and the second transistor T2 are turned on, while a drive signal is output from the data signal terminal Da to write voltage Vdata+Vth to the node N, where Vdata is a voltage of the drive signal and Vth is a threshold voltage of the drive transistor DT. In the illumination phase T3: a low level signal is output from the enable signal terminal EM, the fourth transistor T4 and the fifth transistor T5 are turned on, and the drive transistor DT are turned on under the action of the voltage Vdata+Vth stored in the capacitor C. According to the drive transistor output current formula $I=(\mu WCox/2L)(Vgs-Vth)^2$, where μ is carrier mobility, Cox is gate capacitance per unit area, W is a width of a channel of a drive transistor, L is a length of the channel of the drive transistor, Vgs is a gate source voltage difference of the drive transistor, and Vth is a threshold voltage of the drive transistor. The output current of the drive transistor of the pixel driving circuit in the present disclosure, $I=(\mu WCox/2L)(Vdata+Vth-Vdd-Vth)^2$. This pixel driving circuit can avoid the influence of a threshold of the drive transistor on the output current thereof.

Figure 3:
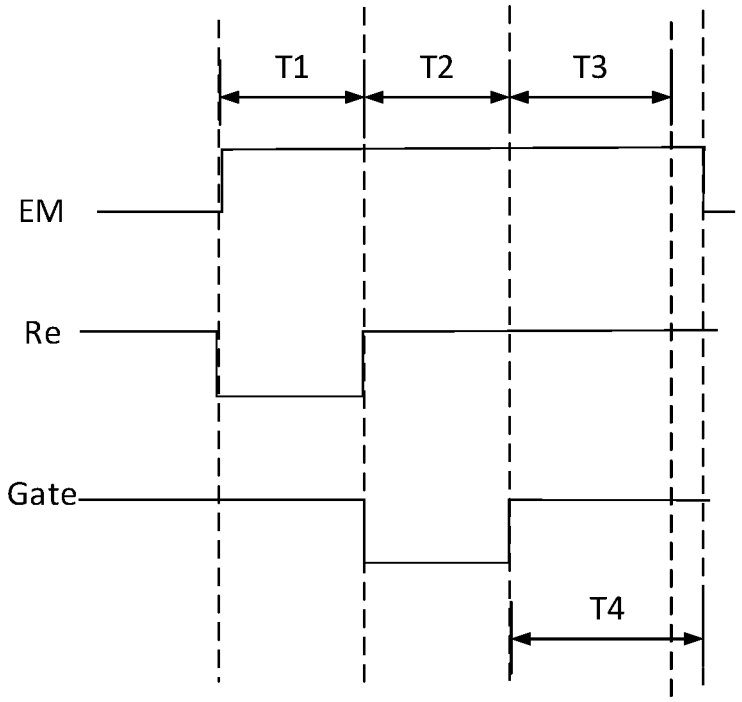
FIG. 3 is a timing diagram of some of the nodes in another exemplary embodiment of the pixel driving circuit shown in FIG. 1.

In addition, an enable signal of the enable signal terminal EM can further adjust the display brightness of a pixel unit. For example, FIG. 3 is a timing diagram of some of the nodes in another exemplary embodiment of the pixel driving circuit illustrated in FIG. 1. The enable signal EM may be kept at a high level during a time period T4, such that the light-emitting unit OLED is in an off state, thus the actual light-emitting duration of the light-emitting unit in a driving cycle may be controlled by controlling the duration of T4, and thus the display brightness of the light-emitting unit may be controlled. The longer the enable signal EM stays at level, the lower the luminance of the light-emitting unit OLED is.

In the related technology, each display brightness value (DBV) on a display panel corresponds to a pulse-width modulation signal and a gamma level. A duty ratio of the pulse-width modulation signal is in positive correlation with that of the above-mentioned enable signal. Each of gamma levels corresponds to a set of gamma data, and the gamma data includes a plurality of gamma voltages, and gray scales and the luminance of the light-emitting unit corresponding to the respective gamma voltages, wherein the luminance of the light-emitting unit is determined by a light-emitting driving current (i.e., the output current of the drive transistor). That is, each display brightness value on the display panel corresponds to a pulse-width modulation signal and a light-emitting driving current. It should be noted that the display brightness value may be interpreted as the display brightness of 255 gray scale in the same gamma level. In $$Lsight = \frac{C*E}{Spixel} \times Id \times PWM \text{ Duty},$$

Lsigh is the display brightness value on the display panel, C*E is the current efficiency of the light-emitting unit, Spixel is a pixel area, Id is the light-emitting driving current, and PWM Duty is the duty ratio of the pulse-width modulation signal. The duty ratio of the pulse-width modulation signal is in direct proportion to the actual light-emitting time of the light-emitting unit in a driving cycle. As can be seen from the above formula, in the related technology, the display brightness value can be adjusted on the display panel by the pulse-width modulation signal and the driving current. Furthermore, in the related technology, the smaller the display brightness value is, the smaller the duty ratio of the pulse-width modulation signal corresponding to the display brightness value is, or the smaller the light-emitting driving current corresponding to the display brightness value is.

However, the current output from the drive transistor DT is susceptible to fluctuations due to external factors (e.g. temperature, humidity, etc.). Especially in the low display brightness value range of the display panel, the drive transistor itself needs to output a smaller current, therefore, under the interference caused by the same external factors, the current output from the drive transistor will be changed by a large proportion, and the light-emitting unit is extremely vulnerable to large fluctuation in brightness. Since the human eyes are more sensitive to changes in brightness in the low brightness range, in the low display brightness value range, the interferences caused by the external factors is more likely to cause color shift of the display panel and other display problems. In addition, especially when the drive transistor DT is a P-type transistor, it can be seen from the above drive transistor output current I formula that, the larger the Vdata is, the smaller the output current is, so that the Vdata is relatively large in the low display brightness value range. Thereby, in the low display brightness value, the pixel driving circuit needs to write more charges to the capacitor C in the compensation phase T2, however, the duration of the compensation phase T2 is limited, therefore, in the low display brightness value, the threshold compensation effect of the above-mentioned pixel driving circuit is poor, thus the display panel is more prone to display abnormality.

The exemplary embodiment provides a method of driving a display panel, and the display panel includes a plurality of sub-pixel units. The method of driving the display panel includes:

at a first display brightness value, inputting a pulse-width modulation signal with a duty ratio of X to the display panel, and controlling the light-emitting driving current of the sub-pixel unit to be M, wherein the duty ratio of the pulse-width modulation signal is in positive correlation with a light-emitting duration of the sub-pixel unit in one driving cycle, and X and M are obtained by a first modulation rule, X>0, and M>0; and at a second display brightness value, inputting the pulse-width modulation signal with a duty ratio of Y1 to the display panel, and controlling the light-emitting driving current of the sub-pixel unit to be N1, wherein the first display brightness value is greater than the second display brightness value, Y1>0, and N1>0, wherein, when the pulse-width modulation signal and the light-emitting driving current corresponding to the second display brightness value are obtained by the first modulation rule, the duty ratio of the pulse-width modulation signal corresponding to the second display brightness value is Y2, the light-emitting driving current corresponding to the second display brightness value is N2, Y2>0, N2>0, Y1 is smaller than Y2, and N1 is greater than N2.

In this exemplary embodiment, the pixel driving circuit of the display panel may be as shown in FIG. 1. As shown in FIG. 2, one driving cycle of the sub-pixel unit may refer to from the start of the reset phase T1 to the start of the next reset phase. N1*Y1 may be equal to N2*Y2.

Figure 4:
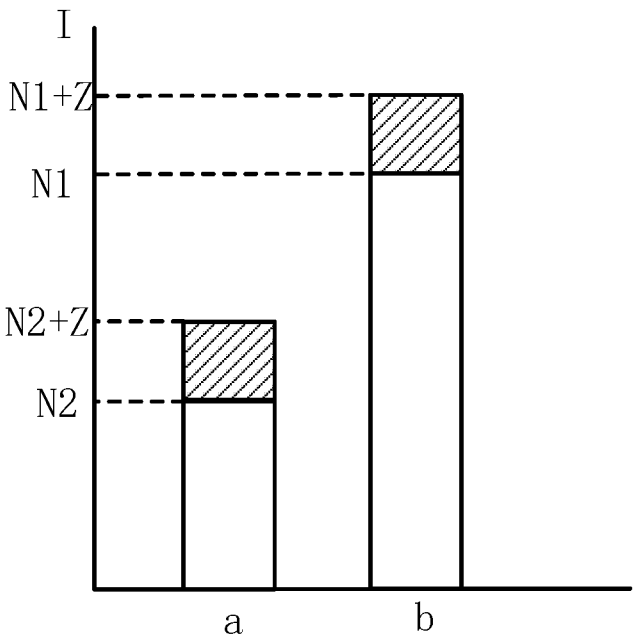
FIG. 4 is an effect diagram in an exemplary embodiment of a method of driving a display panel of the present disclosure.

In this exemplary embodiment, the first modulation rule may be understood as the modulation rule in the prior art. That is, in this exemplary embodiment, based on the correspondence among the display brightness value, the pulse-width modulation signal and the light-emitting driving current in the prior art, when the display brightness value is the second display brightness value that is lower, the light-emitting driving current corresponding to the second display brightness value can be increased while ensuring that the display brightness remains unchanged, by reducing the duty ratio of the pulse-width modulation signal corresponding to the second display brightness value. FIG. 4 is an effect diagram of an exemplary embodiment of the method of driving the display panel of the present disclosure. As shown in the portion a of FIG. 4, when the pulse-width modulation signal and the light-emitting driving current corresponding to the second display brightness value are obtained according to the first modulation rule, the light-emitting driving current corresponding to the second display brightness value is N2, and the changing value of the light-emitting driving current is Z under the interference of external factors. As shown in the portion b of FIG. 4, in the method of driving the display panel of the present disclosure, the light-emitting driving current corresponding to the second display brightness value is N1, the changing value of the light-emitting driving current is Z under the interference of the same external factors. Since Z/N2 is greater than Z/N1, the method of driving the display panel of the present disclosure can reduce the change degree in the display brightness due to the change in the light-emitting driving current, compared with the prior art.

Figure 5:
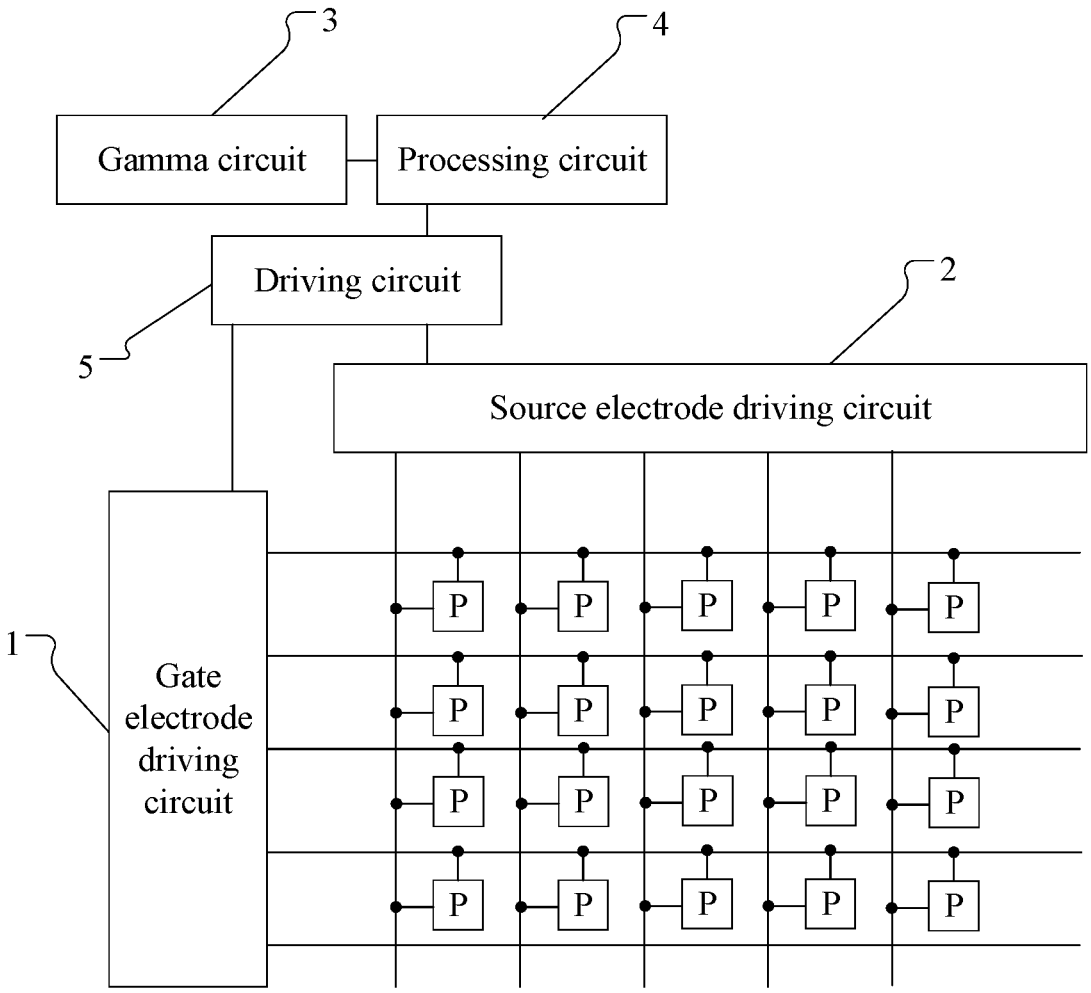
FIG. 5 is a structural schematic diagram of an exemplary embodiment of a display panel of the present disclosure.
Figure 6:
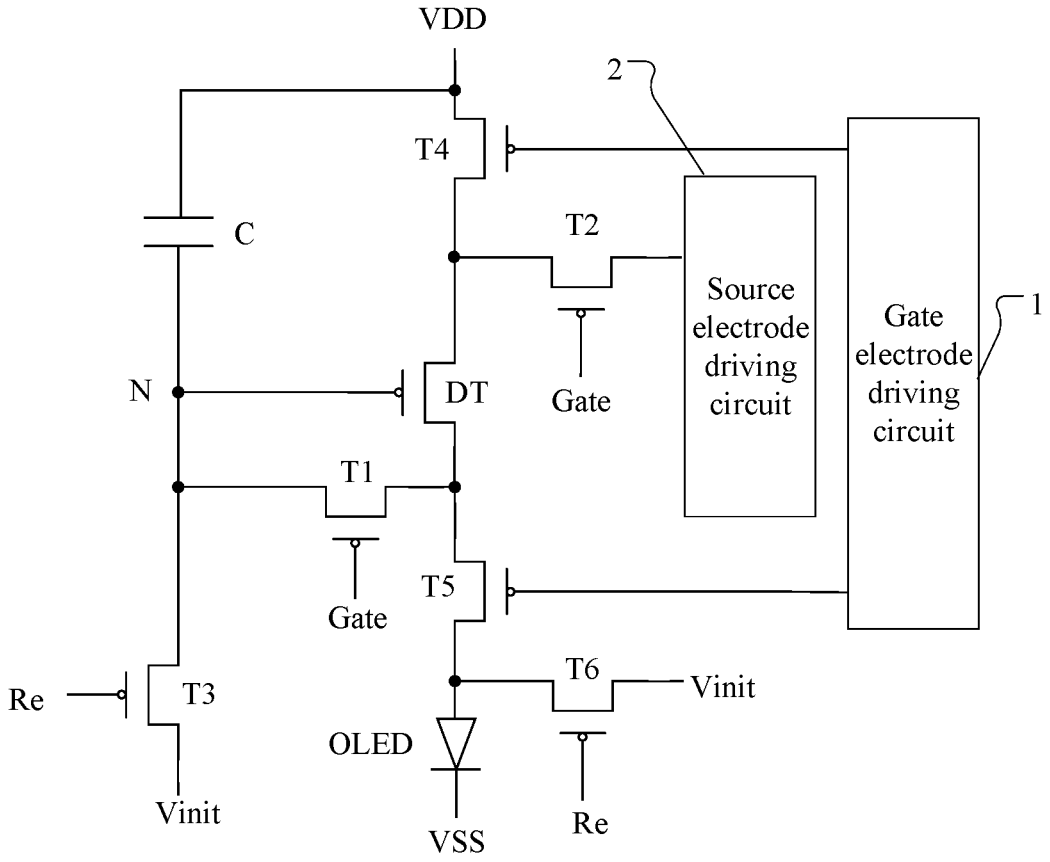
FIG. 6 is a partial structural schematic diagram of an exemplary embodiment of a display panel of the present disclosure.

In this exemplary embodiment, as shown in FIGS. 5 and 6, FIG. 5 is a structural schematic diagram of an exemplary embodiment of the display panel of the present disclosure. FIG. 6 is a partial structural schematic diagram of an exemplary embodiment of a display panel of the present disclosure. The display panel may include a plurality of sub-pixel units P, a gate electrode driving circuit 1, a source electrode driving circuit 2, a gamma circuit 3, a processing circuit 4 and a driving circuit 5. The sub-pixel unit P may include the pixel driving circuit as shown in FIG. 1, wherein the fourth transistor T4 and the fifth transistor T5 may be used to turn on the first power supply terminal VDD and the light-emitting unit OLED in response to an enable signal. The gate electrode driving circuit 1 may be used to provide the enable signal to the fourth transistor T4 and the fifth transistor T5. The source electrode driving circuit 2 may be used to input a driving voltage to the data signal terminal in the pixel driving circuit. The gamma circuit 3 may include a plurality of sets of gamma registers, wherein each set of the gamma registers stores a set of gamma data, each set of gamma data corresponds to a gamma level, and each of the gamma levels corresponds to a display brightness value and a pulse-width modulation signal. The processing circuit 4 may be used, according to the gamma levels corresponding to each set of the gamma registers as well as the display brightness value and the pulse-width modulation signal corresponding to each of the gamma levels, to obtain the pulse-width modulation signal and the gamma level corresponding to any display brightness value. Specifically, the processing circuit may obtain the pulse-width modulation signal and the gamma level corresponding to any of the display brightness values by a difference method. The driving circuit 5 may call the pulse-width modulation signal and the gamma level corresponding to any of the display brightness values, and control the gate electrode driving circuit to output the enable signal based on the pulse-width modulation signal, and control the source electrode driving circuit to output the corresponding driving voltage based on the gamma level.

In this exemplary embodiment, as shown in FIG. 2, the actual light-emitting duration of the sub-pixel unit in one driving cycle is in positive correlation with the duty ratio of the enable signal. The pulse-width modulation signal may control the light-emitting duration of the sub-pixel unit by controlling the duty ratio of the enable signal. Specifically, the gate electrode driving circuit 1 may include a plurality of cascaded shift register cells, each stage of shift register cells may provide an enable signal to the same row of sub-pixel units, and the pulse-width modulation signal may be an input signal of the first stage of shift register cells (i.e., an initial trigger signal of the gate electrode driving circuit). The duty ratio of the initial trigger signal of the gate electrode driving circuit is in positive correlation with the duty ratio of the enable signal. The initial trigger signal of the gate electrode driving circuit cooperates with other clock signals received by the shift register cell, which may control the duty ratio of the enable signal output from the shift register cell.

It should be understood that, in other exemplary embodiments, the pulse-width modulation signal may be other signals as well. For example, the first power supply terminal VDD in FIG. 1 may be a pulse signal, and the pulse-width modulation signal may be used to adjust the duty ratio of the first power supply terminal VDD. In addition, the pixel driving circuit in the display panel of the present disclosure may be other structures as well, all of which fall within the scope of protection of the present disclosure.

In this exemplary embodiment, when the pulse-width modulation signal and the light-emitting driving current corresponding to the second display brightness value are obtained according to the first modulation rule, the second display brightness value may correspond to a first gamma level. Controlling the light-emitting driving current of the sub-pixel unit to be M may include: controlling the light-emitting driving current of the sub-pixel unit based on a second gamma level, wherein, at the same gray scale, a gamma binding voltage corresponding to the second gamma level is smaller than a gamma binding voltage corresponding to the first gamma level, so that the light-emitting driving current generated based on the second gamma level is larger than the light-emitting driving current generated based on the first gamma level. That is, in this exemplary embodiment, the light-emitting driving current of the sub-pixel unit may be adjusted by adjusting the gamma level corresponding to the second display brightness value. Specifically, in this exemplary embodiment, the gamma level corresponding to the second display brightness value may be adjusted by adjusting the gamma data in the above-described gamma shift register. It should be understood that the light-emitting driving current of the sub-pixel unit may be controlled to be M by other methods, for example, a driving voltage is input to the pixel driving circuit based on the first gamma level and at the same time the voltage at the data signal terminal of the pixel driving circuit is compensated by a voltage compensation circuit.

In this exemplary embodiment, the second display brightness value may be equal to or less than K1, and the first display brightness value may be greater than K1. The method of driving the display panel provided in this exemplary embodiment may adopt the same driving method as that of the second display brightness value in a brightness range in which the display brightness value is equal to or less than K1, and adopt the same driving method as that of the first display brightness value in a brightness range in which the display brightness value is greater than K1, as well. K1 may be equal to or greater than 2, and K1 is equal to or less than 32, for example, K1 may be 2, 5, 10, 15, 20, 25, 30 or 32.

In this exemplary embodiment, Y1 may be less than X, and N1 may be greater than M. It should be understood that in other exemplary embodiments, N1 may be equal to or less than M as well.

In an exemplary embodiment, a display panel dimming method may be a combination of a pulse-width modulation signal dimming method (PWM) and a power dimming method (DC). That is, when the display brightness value of the display panel is greater than K2, the display panel may adjust the display brightness value of the display panel by the power dimming method, and when the display brightness value of the display panel is equal to or less than K2, the display panel can adjust the display brightness value of the display panel by the pulse-width modulation signal dimming method. The pulse-width modulation signal dimming manner refers to the adjustment of the display brightness value by adjusting the light-emitting duration of the light-emitting unit in one driving cycle. In the exemplary embodiment, the pulse-width modulation signal dimming mode may adjust the light-emitting duration of the light-emitting unit in one driving cycle by the above-mentioned pulse-width modulation signal. The power dimming mode refers to the adjustment of the display brightness value by adjusting the driving power of the display panel. In the power dimming mode, the duty ratio of the pulse-width modulation signal may be 100%. In the exemplary embodiment, K1 may be less than K2, that is, the above driving method of the second display brightness value may be implemented in a dimming range of the pulse-width modulation signal dimming mode. For example, the second display brightness value may be 2 nits, Y2 is 10%, and Y1 is 2%. It should be understood that K1 may be equal to or greater than K2 as well, that is, the above driving method of the second display brightness value may be implemented in the dimming range of the power dimming mode. For example, the second display brightness value may be 500 nits, Y2 is 100% ,and Y1 is 50%. In addition, in other exemplary embodiments, the display panel dimming method may be the pulse-width modulation signal dimming method (PWM), or be the power dimming method (DC). In the pulse-width modulation signal dimming mode (PWM) or the power dimming mode (DC), the display panel may still adopt the above driving method.

Figure 7:
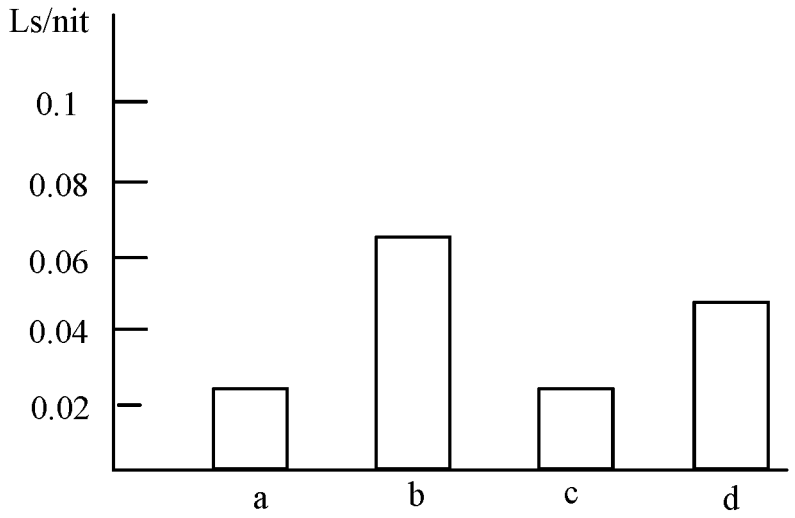
FIG. 7 is an effect diagram of comparison between a method of driving a display panel in the prior art and the method of driving the display panel in the present disclosure.

FIG. 7 is an effect diagram of comparison between the method of driving the display panel in the prior art and the method of driving the display panel in the present disclosure. In the method of driving the display panel in the prior art, the duty ratio corresponding to the display brightness value of 2 nits is 10%, and in the method of driving the display panel in the present disclosure, the duty ratio corresponding to the display brightness value of 2 nits is 2%. As shown in the portion a in FIG. 7, the display brightness of the method of driving the display panel in the prior art is 0.02 nits in the case of the display brightness value of 2 nits and a gray scale of 32. As shown in the portion b in FIG. 7, the display brightness of the display panel in the prior art is 0.065 nits in the case of the display brightness value of 2 nits and a gray scale of 32 after 240 hours of THO (high temperature and high humidity, 60° C., 90% RH) test, and the screen turns visually green. As shown in the portion c in FIG. 7, the display brightness of the method of driving the display panel in the present disclosure is 0.02 nits in the case of the display brightness value of 2 nits and a gray scale of 32. As shown in the portion d in FIG. 7, the display brightness of the display panel in the present disclosure is 0.045 nits in the case of the display brightness value of 2 nits and a gray scale of 32 after 240 hours of THO (high temperature and high humidity, 60° C., 90% RH) test, and the visual effect of the screen is better. The display panel and the method of driving the same in the present disclosure have stronger anti-interference capability.

The exemplary embodiment further provides a method of driving the display panel, including:

at the first display brightness value, inputting the pulse-width modulation signal with the duty ratio of X to the display panel, and controlling the light-emitting driving current of the sub-pixel unit in the display panel to be M; and at the second display brightness value, inputting the pulse-width modulation signal with the duty ratio of Y1 to the display panel, and controlling the light-emitting driving current of the sub-pixel unit in the display panel to be N1, wherein the duty ratio of the pulse-width modulation signal is in positive correlation with the light-emitting duration of the sub-pixel unit in one driving cycle, the first display brightness value is greater than the second display brightness value, N1>M, and Y1<X.

At the second display brightness value, the method of driving the display panel increases the light-emitting driving current of the sub-pixel unit from M in the prior art to N1, while maintaining the second display brightness value by decreasing the duty ratio of the pulse-width modulation signal. The exemplary embodiment can improve the display effect of the display panel by increasing the light-emitting driving current at a low display brightness value.

In the exemplary embodiment, the second display brightness value is equal to or less than K1, and the first display brightness value is greater than K1. The method of driving the display panel provided in this exemplary embodiment can use the same driving method as that of the second display brightness value in the brightness range where the display brightness value is equal to or less than K1, and use the same driving method as that of the first display brightness value in the brightness range where the display brightness value is greater than K1, as well. K1 may be equal to or greater than 2, and K1 is equal to or less than 32, for example, K1 may be 2, 5, 10, 15, 20, 25, 30 or 32.

This method of driving the display panel provided in the exemplary embodiment may have the same technical features and working principles as those of the above-mentioned method of driving the display panel as well, which will not be elaborated here.

This exemplary embodiment further provides a display panel, which is driven according to the above-mentioned method of driving the display panel. The method of driving the display panel has been described in detail above, which will not be elaborated here.

This exemplary embodiment further provides a display panel, including: a plurality of sub-pixel units, a gate electrode driving circuit, a source electrode driving circuit, a gamma circuit, a processing circuit and a driving circuit. The sub-pixel unit includes a pixel driving circuit, the pixel driving circuit includes a first switching element connected between a first power supply terminal and a light-emitting unit, and the first switching element is configured to turn on the first power supply terminal and the light-emitting unit in response to an enable signal. The gate electrode driving circuit is configured to provide the enable signal to the first switching unit. The source electrode driving circuit is configured to input a driving voltage to the pixel driving circuit. The gamma circuit includes a plurality of sets of gamma registers, each set of gamma registers stores a set of gamma data, each set of gamma data corresponds to a gamma level, and each of the gamma levels corresponds to a display brightness value and a pulse-width modulation signal. The processing circuit is configured, according to the gamma levels corresponding to each set of gamma register as well as the display brightness value and the pulse-width modulation signal corresponding to each of the gamma levels, to obtain the pulse-width modulation signal and the gamma level corresponding to any display brightness value. The driving circuit is configured to call the pulse-width modulation signal and the gamma level corresponding to any display brightness value, to control the gate electrode driving circuit to output the enable signal based on the pulse-width modulation signal, and at the same time control the source electrode driving circuit to output the driving voltage based on the gamma level. A duty ratio of the pulse-width modulation signal corresponding to a first display brightness value is X, the first display brightness value corresponds to a third gamma level, and based on the third gamma level, the light-emitting driving current of the pixel driving circuit is M, the pulse-width modulation signal and the gamma level corresponding to the first display brightness value are obtained according to the first modulation rule, X>0, and M>0. The duty ratio of the pulse-width modulation signal corresponding to the second display brightness value is Y1, the second display brightness value corresponds to a second gamma level, and based on the second gamma level, the light-emitting driving current of the pixel driving circuit is N1, Y1>0, and N1>0. When the pulse-width modulation signal and the gamma level corresponding to the second display brightness value are obtained according to the first modulation rule, the duty ratio of the pulse-width modulation signal corresponding to the second display brightness value is Y2, the light-emitting driving current of the pixel driving circuit is N2, Y2>0, N2>0, Y1 is less than Y2, and N1 is greater than N2.

In this exemplary embodiment, the second display brightness value may be equal to or less than K1, and the first display brightness value may be greater than K1. K1 may be equal to or greater than 2, and K1 is equal to or less than 32, for example, K1 may be 2, 5, 10, 15, 20, 25, 30 or 32.

In this exemplary embodiment, the second display brightness value corresponds to the first gamma level when the pulse-width modulation signal and the gamma level corresponding to the second display brightness value are obtained according to the first modulation rule, wherein the light-emitting driving current generated based on the second gamma level is greater than the light-emitting driving current generated based on the first gamma level at the same gray scale.

Based on the method of driving a display panel, described above, the example embodiment further provides a method of dimming the display panel, including:

obtaining pulse-width modulation signals and light-emitting driving currents corresponding to a first display brightness value and a second display brightness value, having different display brightness values based on the first modulation rule, wherein the first display brightness value is larger than the second display brightness value, wherein the duty ratio of the pulse-width modulation signal corresponding to the second display brightness value is Y2, the light-emitting driving current is N2, Y2>0, N2>0, and the second display brightness value is equal to or less than K1; and adjusting the duty ratio Y2 of the pulse-width modulation signal corresponding to the second display brightness value to Y1, and adjusting the light-emitting driving current corresponding to the second display brightness value to N1, wherein Y1>0, N1>0, Y1 is less than Y2, and N1 is greater than N2.

This exemplary embodiment further provides a display device including the above-mentioned display panel. The display device may be a display device such as a cell phone, a tablet computer, a television.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A method of driving a display panel, comprising:

providing the display panel, wherein the display panel comprises a plurality of sub-pixel units;

at a first display brightness value, inputting a pulse-width modulation signal with a duty ratio of X to the display panel, and controlling a light-emitting driving current of the sub-pixel unit to be M, wherein the duty ratio of the pulse-width modulation signal is in positive correlation with a light-emitting duration of the sub-pixel unit in one driving cycle, wherein X and M are obtained according to a first modulation rule, X>0, and M>0; and at a second display brightness value, inputting the pulse-width modulation signal with a duty ratio of Y1 to the display panel, and controlling the light-emitting driving current of the sub-pixel unit to be N1, wherein the first display brightness value is greater than the second display brightness value, Y1>0, and N1>0, wherein, when the pulse-width modulation signal and the light-emitting driving current corresponding to the second display brightness value are obtained according to the first modulation rule, the duty ratio of the pulse-width modulation signal corresponding to the second display brightness value is Y2, the light-emitting driving current corresponding to the second display brightness value is N2, Y2>0, N2>0, Y1 is smaller than Y2, and N1 is greater than N2.

2. The method of driving the display panel according to claim 1, wherein the second display brightness value is equal to or less than K1, and the first display brightness value is greater than K1.

3. The method of driving the display panel according to claim 2, wherein K1 is equal to or greater than 2 nits, and K1 is equal to or less than 32 nits.

4. The method of driving the display panel according to claim 1, wherein:

the sub-pixel unit comprises a pixel driving circuit and a light-emitting unit, the pixel driving circuit comprises a first switching element connected between a first power supply terminal and a light-emitting unit, and the first switching unit is configured to turn on the first power supply terminal and the light-emitting unit in response to an enable signal, and the duty ratio of the pulse-width modulation signal is in positive correlation with a duty ratio of the enable signal.

5. The method of driving the display panel according to claim 4, wherein:

the display panel comprises a gate electrode driving circuit, and the gate electrode driving circuit is configured to provide the enable signal to the first switching unit, and the pulse-width modulation signal is an initial trigger signal of the gate electrode driving circuit.

6. The method of driving the display panel according to claim 1, wherein Y1 is smaller than X, and N1 is greater than M.

7. The method of driving the display panel according to claim 1, wherein, when the pulse-width modulation signal and the light-emitting driving current corresponding to the second display brightness value are obtained according to the first modulation rule, the second display brightness value corresponds to a first gamma level, and controlling the light-emitting driving current of the sub-pixel unit to be M comprises:

controlling the light-emitting driving current of the sub-pixel unit based on a second gamma level, wherein the light-emitting driving current generated based on the second gamma level is greater than the light-emitting driving current generated based on the first gamma level at a same gray scale.

8. The method of driving the display panel according to claim 1, wherein N1*Y1 is equal to N2*Y2.

9. A method of driving a display panel, comprising:

at a first display brightness value, inputting a pulse-width modulation signal with a duty ratio of X to the display panel, and controlling a light-emitting driving current of a sub-pixel unit in the display panel to be M; and at a second display brightness value, inputting the pulse-width modulation signal with a duty ratio of Y1 to the display panel, and controlling the light-emitting driving current of the sub-pixel unit in the display panel to be N1, wherein the duty ratio of the pulse-width modulation signal is in positive correlation with a light-emitting duration of the sub-pixel unit in one driving cycle, the first display brightness value is greater than the second display brightness value, N1>M, and Y1<X.

10. The method of driving the display panel according to claim 9, wherein the second display brightness value is equal to or less than K1, and the first display brightness value is greater than K1.

11. The method of driving the display panel according to claim 9, wherein:

the sub-pixel unit comprises a pixel driving circuit and a light-emitting unit, the pixel driving circuit comprises a first switching element connected between a first power supply terminal and a light-emitting unit, and the first switching unit is configured to turn on the first power supply terminal and the light-emitting unit in response to an enable signal, and the duty ratio of the pulse-width modulation signal is in positive correlation with a duty ratio of the enable signal.

12. The method of driving the display panel according to claim 11, wherein:

the display panel comprises a gate electrode driving circuit, and the gate electrode driving circuit is configured to provide the enable signal to the first switching unit, and the pulse-width modulation signal is an initial trigger signal of the gate electrode driving circuit.

13. The method of driving the display panel according to claim 9, wherein X and M are obtained according to a first modulation rule and, when the pulse-width modulation signal and the light-emitting driving current corresponding to the second display brightness value are obtained according to the first modulation rule, the second display brightness value corresponds to a first gamma level, and controlling the light-emitting driving current of the sub-pixel unit to be M comprises:

controlling the light-emitting driving current of the sub-pixel unit based on a second gamma level, wherein the light-emitting driving current generated based on the second gamma level is greater than the light-emitting driving current generated based on the first gamma level at a same gray scale.

14. A display panel, comprising:

a plurality of sub-pixel units, wherein each of the sub-pixel units comprises a pixel driving circuit, the pixel driving circuit comprising a first switching element connected between a first power supply terminal and a light-emitting unit, and the first switching unit being configured to turn on the first power supply terminal and the light-emitting unit in response to an enable signal; and a gate electrode driving circuit configured to provide the enable signal to the first switching unit;

a source electrode driving circuit configured to input a driving voltage to the pixel driving circuit;

a gamma circuit comprising a plurality of sets of gamma registers, wherein each set of gamma registers stores a set of gamma data, each set of gamma data corresponds to a gamma level, and each of the gamma levels corresponds to a display brightness value and a pulse-width modulation signal;

a processing circuit configured to, according to the gamma levels corresponding to each set of gamma registers as well as the display brightness value and the pulse-width modulation signal corresponding to each of the gamma levels, obtain the pulse-width modulation signal and the gamma level corresponding to any display brightness value; and a driving circuit configured to call the pulse-width modulation signal and the gamma level corresponding to any display brightness value, to control the gate electrode driving circuit to output the enable signal based on the pulse-width modulation signal, and control the source electrode driving circuit to output the driving voltage based on the gamma level, wherein a duty ratio of the pulse-width modulation signal corresponding to a first display brightness value is X, the first display brightness value corresponds to a third gamma level, and based on the third gamma level, a light-emitting driving current of the pixel driving circuit is M, the pulse-width modulation signal and the gamma level corresponding to the first display brightness value are obtained according to a first modulation rule, X>0, and M>0, a duty ratio of the pulse-width modulation signal corresponding to a second display brightness value is Y1, the second display brightness value corresponds to a second gamma level, and based on the second gamma level, the light-emitting driving current of the pixel driving circuit is N1, Y1>0, and N1>0, and when the pulse-width modulation signal and the gamma level corresponding to the second display brightness value are obtained according to the first modulation rule, the duty ratio of the pulse-width modulation signal corresponding to the second display brightness value is Y2, the light-emitting driving current of the pixel driving circuit is N2, Y2>0, N2>0, Y1 is less than Y2, and N1 is greater than N2.

15. The display panel according to claim 14, wherein the second display brightness value is equal to or less than K1, and the first display brightness value is greater than K1.

16. The display panel according to claim 14, wherein:

the second display brightness value corresponds to a first gamma level when the pulse-width modulation signal and the gamma level corresponding to the second display brightness value are obtained according to the first modulation rule, and the light-emitting driving current generated based on the second gamma level is greater than the light-emitting driving current generated based on the first gamma level at a same gray scale.

17. The display panel according to claim 14, wherein the display panel is implemented in a display device.

* * * * *